US009799185B2

(12) United States Patent
Jessop

(10) Patent No.: US 9,799,185 B2
(45) Date of Patent: Oct. 24, 2017

(54) METHOD, DEVICE, AND COMPUTER PROGRAM FOR MOBILE ASSET TRACKING

(76) Inventor: Gordon Jessop, Delta (CA)

( * ) Notice: Subject to any disclaimer, the term of this patent is extended or adjusted under 35 U.S.C. 154(b) by 0 days.

(21) Appl. No.: 13/446,440

(22) Filed: Apr. 13, 2012

(65) Prior Publication Data

US 2013/0271281 A1 Oct. 17, 2013

(51) Int. Cl.

| | |
|---|---|
| ***G08B 1/08*** | (2006.01) |
| ***G08B 13/24*** | (2006.01) |
| *G08B 21/02* | (2006.01) |

(52) U.S. Cl.

CPC ..... *G08B 13/2462* (2013.01); *G08B 21/0269* (2013.01); *G08B 21/0261* (2013.01)

(58) Field of Classification Search

CPC .... G08B 21/18; G08B 21/023; G08B 21/025; G08B 21/0261; G08B 21/0269; H04W 4/023; G01S 5/0027; H04M 1/72502; A01K 15/021; A01K 11/008; A01K 27/009; H04L 1/0007; H04L 1/0009; H04L 1/0034; H04L 1/1803; H04L 1/1825; H04L 1/1854

See application file for complete search history.

(56) References Cited

U.S. PATENT DOCUMENTS 4,745,564 A * 5/1988 Tennes ..... G01P 1/127 346/33 D
4,888,580 A * 12/1989 Distel ..... 340/573.1
6,067,018 A * 5/2000 Skelton et al. ..... 340/573.3
6,125,686 A * 10/2000 Haan ..... G01P 1/127 73/12.04
6,271,757 B1 * 8/2001 Touchton ..... A01K 15/02 119/721
6,353,390 B1 * 3/2002 Beri ..... G08B 13/1427 340/572.1
6,720,879 B2 * 4/2004 Edwards ..... 340/573.3
7,760,137 B2 * 7/2010 Martucci et al. ..... 342/357.39
7,801,542 B1 * 9/2010 Stewart ..... 455/518
8,688,375 B2 * 4/2014 Funk et al. ..... 701/495
8,878,670 B2 * 11/2014 Rosen et al. ..... 340/539.13
2003/0109988 A1 * 6/2003 Geissler et al. ..... 701/213
2004/0136527 A1 * 7/2004 Struik ..... H04L 1/1803 380/28
2004/0183674 A1 * 9/2004 Ruvarac ..... 340/539.13
2004/0226392 A1 * 11/2004 McNally ..... G01D 21/02 73/866.1
2006/0011145 A1 * 1/2006 Kates ..... A01K 15/021 119/719
2006/0202818 A1 * 9/2006 Greenberg ..... 340/539.13
(Continued)

*Primary Examiner* — John A Tweel, Jr.
*Assistant Examiner* — Adnan Aziz
(74) *Attorney, Agent, or Firm* — Eugene J. A. Gierczak

(57) ABSTRACT

A device, remote control, and web application for tracking mobile assets are disclosed. The device is attached to the mobile asset. The remote control enables or disables the device, and communicates to a user the location and status of the device. The web application can also be used for tracking the device and providing advanced features. The device includes a GPS transceiver and an accelerometer for determining its location and travel parameters. The web application includes a map to give a visual representation of the device location. Also disclosed is a social networking feature of the device, which is optimally utilized where the device is used for tracking of pets by owners.

13 Claims, 6 Drawing Sheets

(56) References Cited

U.S. PATENT DOCUMENTS

2007/0056369 A1* 3/2007 Griffin ..... G01P 1/127 73/504.14
2007/0204804 A1* 9/2007 Swanson et al. ..... 119/721
2007/0229350 A1* 10/2007 Scalisi ..... G06F 21/35 342/350
2008/0061993 A1* 3/2008 Fong ..... G08B 21/22 340/573.4
2008/0225842 A1* 9/2008 Goldfein ..... H04L 47/25 370/389
2009/0259349 A1* 10/2009 Golenski ..... G08G 1/205 701/2
2009/0267829 A1* 10/2009 Mitchell et al. ..... 342/357.07
2009/0289844 A1* 11/2009 Palsgrove et al. ..... 342/357.07
2009/0315767 A1* 12/2009 Scalisi ..... G01S 19/49 342/357.74
2010/0097208 A1* 4/2010 Rosing et al. ..... 340/539.13
2010/0289644 A1* 11/2010 Slavin ..... G08B 13/2402 340/568.1
2010/0311385 A1* 12/2010 Hurwitz ..... G08B 25/016 455/404.1
2011/0193706 A1* 8/2011 Dickerson ..... 340/573.3
2011/0238755 A1* 9/2011 Khan et al. ..... 709/204
2011/0244798 A1* 10/2011 Daigle et al. ..... 455/41.2
2012/0190386 A1* 7/2012 Anderson ..... 455/456.3
2013/0099920 A1* 4/2013 Song ..... G08B 21/023 340/539.13
2013/0127617 A1* 5/2013 Baade et al. ..... 340/539.31
2013/0157628 A1* 6/2013 Kim et al. ..... 455/414.1
2013/0194185 A1* 8/2013 McLoughlin et al. ..... 345/163
2013/0226369 A1* 8/2013 Yorio ..... G06F 17/00 701/1
2014/0203972 A1* 7/2014 Vock ..... A43B 3/0005 342/463

* cited by examiner

METHOD, DEVICE, AND COMPUTER PROGRAM FOR MOBILE ASSET TRACKING

FIELD OF THE INVENTION

The present invention relates to tracking of mobile assets. The present invention more particularly relates to a device that uses GPS to communicate the location of a mobile asset to a user using a remote control and web application.

BACKGROUND

Various devices and methods for locating items, assets and animals have heretofore been devised and used in the prior art.

For example, U.S. Pat. No. 5,742,233 relates to a personal security and tracking system. Moreover, US patent number 2002/0021219 relates to an animal collar including tracking and location device. Furthermore, U.S. Pat. No. 6,067,018 relates to a lost pet notification system. Moreover, U.S. Pat. No. 6,362,778 relates to a personal location detection system.

Moreover, WO03/035316 relates to an animal collar capable of performing a number of functions which includes an illumination device that illuminates the collar either automatically or responsive to manual activation. The animal collar is alto provided with an audio recorder that may be used to plant pre-recorded messages that identify the contact information of the pet owner.

Furthermore, US patent applications 2004/0014478 relates to a personal security and tracking system, while WO03082459 and US 20010044321 relates to other tracking devices.

A system and method for surveillance of animals is disclosed in 2004/00616006 while U.S. Pat. No. 6,683,585 relates to a self-contained selectively activated mobile object position reporting device with reduced power consumption and minimized wireless service fees. Other arrangements are disclosed in U.S. Pat. No. 5,588,398 that relates to a remotely controlled dog muscle while U.S. Pat. No. 6,720,879 relates to an animal collar including a tracking and location device.

US 2002/0173344 relates to a personal electronics device.

SUMMARY

In one aspect of the present invention, a device for mobile asset tracking is described, the device provided: (a) a housing; (b) a battery; (c) a battery charging circuit; (d) a positional tracking circuit; (e) an accelerometer; (f) a means for activating and deactivating the device; and (g) a visual indicator for communicating messages to a user of the device.

The device has a particular application for lost pets, tracking people, assets, warehoused items, or items being moved by land, air or water.

In another aspect of the present invention, a method for mobile asset tracking is described, wherein the method provided the steps of: (a) attaching a first device to an asset, the device operable to communicate its location to a second device; and (b) a user being in possession of the second device, the second device communicating to the user the location of the first device.

In yet another aspect of the present invention, a computer program comprising computer instructions which when made available to a computer are operable to define in relation to the computer a mobile asset tracking utility is provided, the computer program operable to: (a) receive location information from a device; (b) display on a map the location of the device; (c) enable a user to enable or disable travel boundaries for the device, wherein an alert is provided to the user if the device travels outside the travel boundaries; (d) enable a user to enable or disable a timeframe for said travel boundaries to be activated; and (e) enable a user to configure a radius and centerpoint for said travel boundaries.

In a further aspect of the present invention, a method for social networking is provided, the method comprising: (a) a plurality of users each obtaining a device and remote control, the device including location based tracking means; (b) each user registering the device with a central registration application, said registration including providing a label to the device; (c) the central registration application communicating the label to the device; (d) the device communicating the label to the remote control; (e) the remote control including a sensing function wherein it is operable to sense another user's remote control within a certain physical range; and (f) the remote controls exchanging a greeting when they are within the certain physical range.

BRIEF DESCRIPTION OF THE DRAWINGS

A detailed description of one or more embodiments is provided herein below by way of example only and with reference to the following drawings, in which.

It is to be expressly understood that the description and drawings are only for the purpose of illustration and as an aid to understanding, and are not intended as a definition of the limits of the present invention.

DETAILED DESCRIPTION

The present invention discloses a method, device, and computer program for mobile asset tracking. In one embodiment of the device, a pet tracking device is provided. It should be apparent to those skilled in the art that this embodiment may be extended to any other type of asset, and the methods and computer program claimed herein could likewise be extended. More particularly the device can be used for anything that can be tracked for example, but without limiting the application, pets, people, children, assets and the like.

Figure 1:
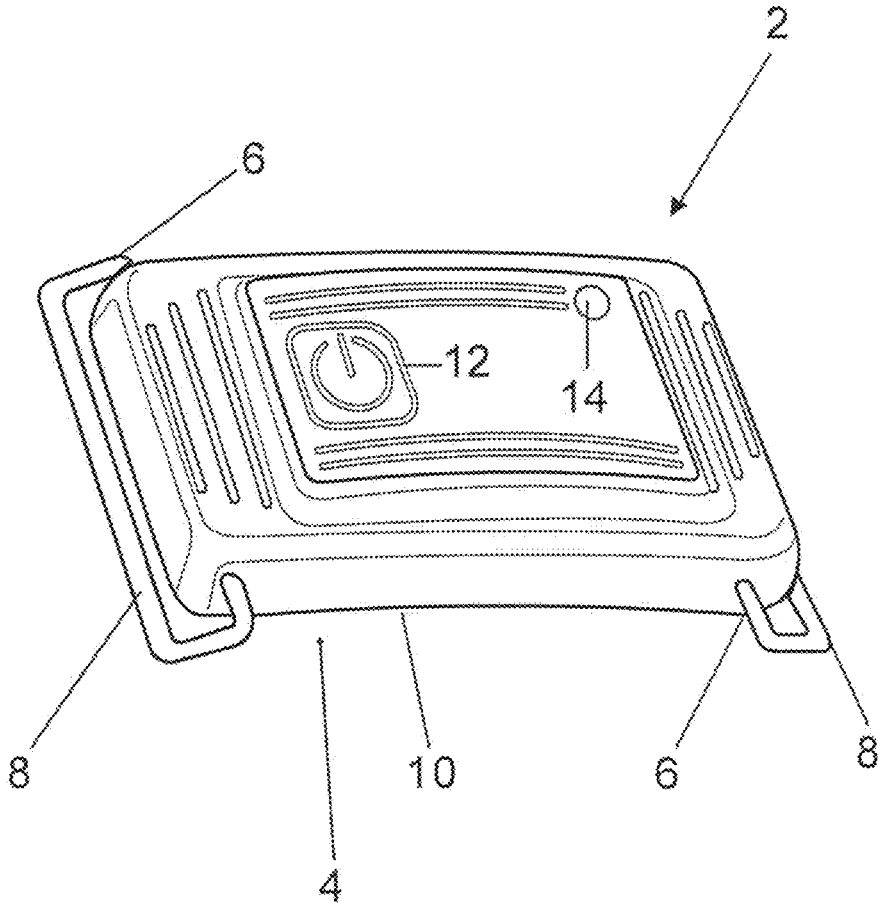
FIG. 1 illustrates a particular embodiment of the device of the present invention.

FIG. 1 illustrates one embodiment of the tracking device 2. In the embodiment shown in FIG. 1 the tracking device acts as a pet tracking device comprising a housing 4 attachable to a pet collar (not shown). This may be provided by tooling four indentations 6 into the edges of the housing 4 to accommodate a belt or collar D-rings 8 at either end of the device and maintain air/water right seal.

The device may be permanently sealed by a waterproof shell. The shell may be made of a silicone based material or rubber based material, in either of which cases it would optimally display impact resistance and comfort to a pet to which it is attached. The silicone may also permit the device to be completely scaled and protected from air, water, scratches, dust, and other like elements that could otherwise harm the device. One type of material that can be used is sold under the trade-mark GORTEX.

In the embodiment of the device wherein it is a pet tracking device 2 for attachment to a pet collar, the device may be shaped such that its back edge 8 is an arc or concave. This will allow the device to be more comfortably worn by a pet.

There may also be provided means, such as a button 12, for activating and deactivating the device 2. A visual indicator 14, such as an LED, may also be provided for indicating whether the device is currently activated or deactivated. The silicone or rubber casing may be made translucent over top of the LED to allow a person to see whether the LED is on or off.

The device may include a battery. The battery may be charged using a magnetic induction battery charging device. No internal components, including the battery, need to be accessible where the magnetic induction battery charging device, described below, is used.

There may also be provided on the device 2 a connection for the magnetic induction charging system. The operation of magnetic induction charging systems is known to those skilled in the art. A connection area may be provided on the device, such that it may pair or mate with the charger. The connection area may be flush with the surface of the device for aesthetic reasons or an indentation in the device for ease of mating with the charger. The connection area may be provided with the silicone or rubber protective coating, since a magnetic induction charging system does not typically require the connection to come into physical contact with the charger.

The device may include features enabling it to provide positional tracking capabilities, including a global positioning system (GPS) transceiver and an accelerometer to sense positional acceleration of the device. In the device of the present invention, a two or three axes accelerometer may be utilized to sense change in the three dimensional position of the device. Sensing of altitude may be optionally enabled. The position of the device is used for both the allowed device travel boundaries and for locating a lost asset.

The accelerometer can be used to indicate if a pet is located out of a Geofence which can indicate the pet is lost or stolen. Also the accelerometer can be used for insurance purposes in the event a fragile article such as glass is cracked and the accelerometer can determine where and when the article was exposed to an impact or acceleration.

The device may require an antenna wire for use with cellular systems and satellite systems. In this case, the antenna may be routed in the device, also sealed by the protective coating.

Figure 2:
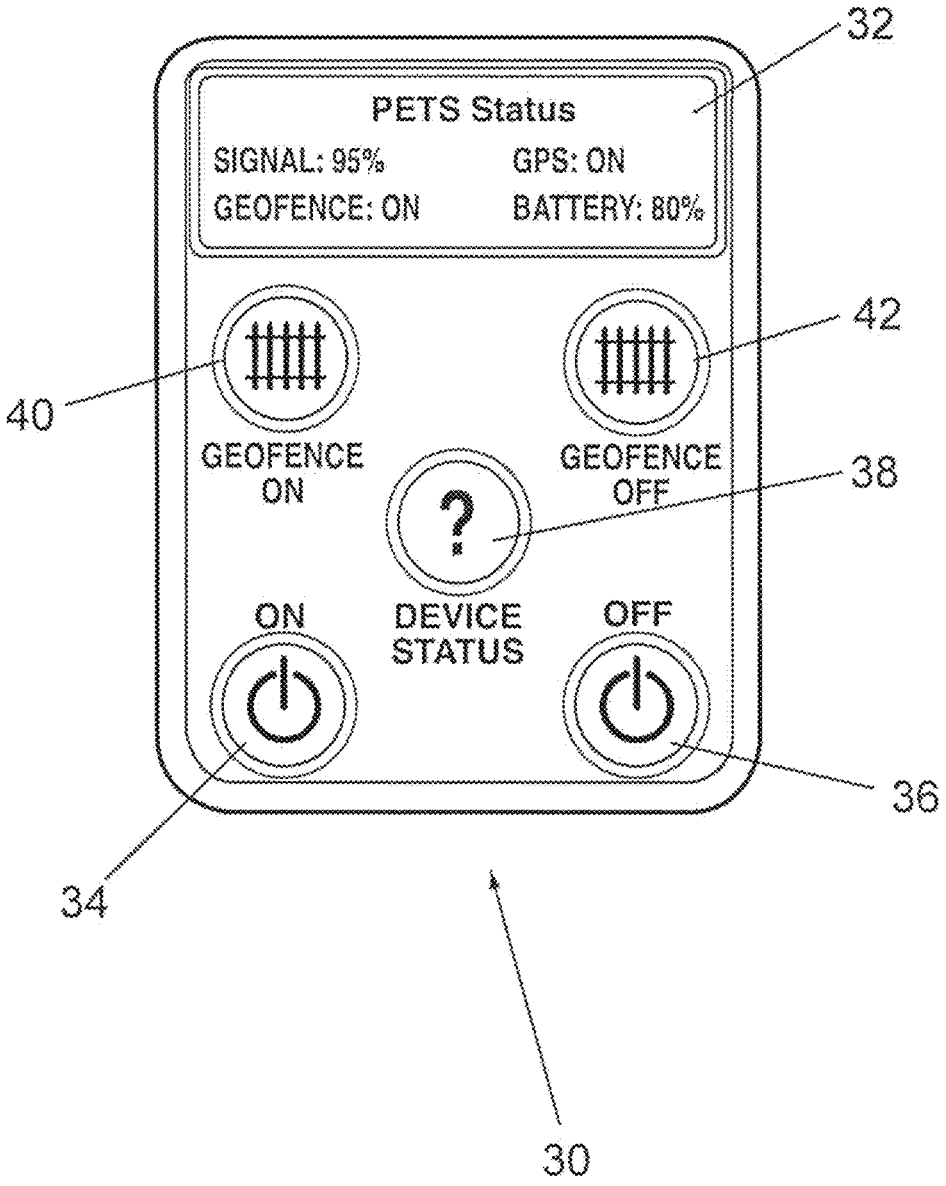
FIG. 2 illustrates a particular embodiment of a remote control for use with the device previously illustrated in FIG. 1.

FIG. 2 illustrates a remote control 30 that may be provided for controlling the device 2. The remote control 30 may have a display screen 32 for communicating messages to a user operating the device 2. The display screen 32 may display text and/or graphics including providing the device's signal level, battery level, GPS activation status, and whether allowed device travel boundaries or Geofence are enabled. The allowed device travel boundaries are described more fully below.

The remote control 30 may also be provided with several input means. For example, the remote control 30 may have buttons corresponding to features, such as activating 34 and deactivating 36 the device 2, querying the current device status 38 (which may result in the display screen displaying the status), and activating 40 and deactivating 42 the allowed device travel boundaries. A user may desire to deactivate the allowed device travel boundaries to permit the device to asset to travel freely. When a user activates the allowed device travel boundaries using the remote control 30, the boundaries are set at a predetermined radius around the current location of the device. The current location of the device may be determined using the global positioning transceiver described below.

A Geofence is a virtual perimeter for a real world geographic area. Geofencing is a feature in a software program that uses the global positioning system (GPS) or radio frequency identification (RFID) to define geographical boundaries. A Geofence is a virtual boundary.

Geofence programs allow an administrator to set up triggers so when a device crosses a Geofence and enters or exits the boundaries defined by the administrator a small message signal (SMS) or email alert is sent.

Figure 4:
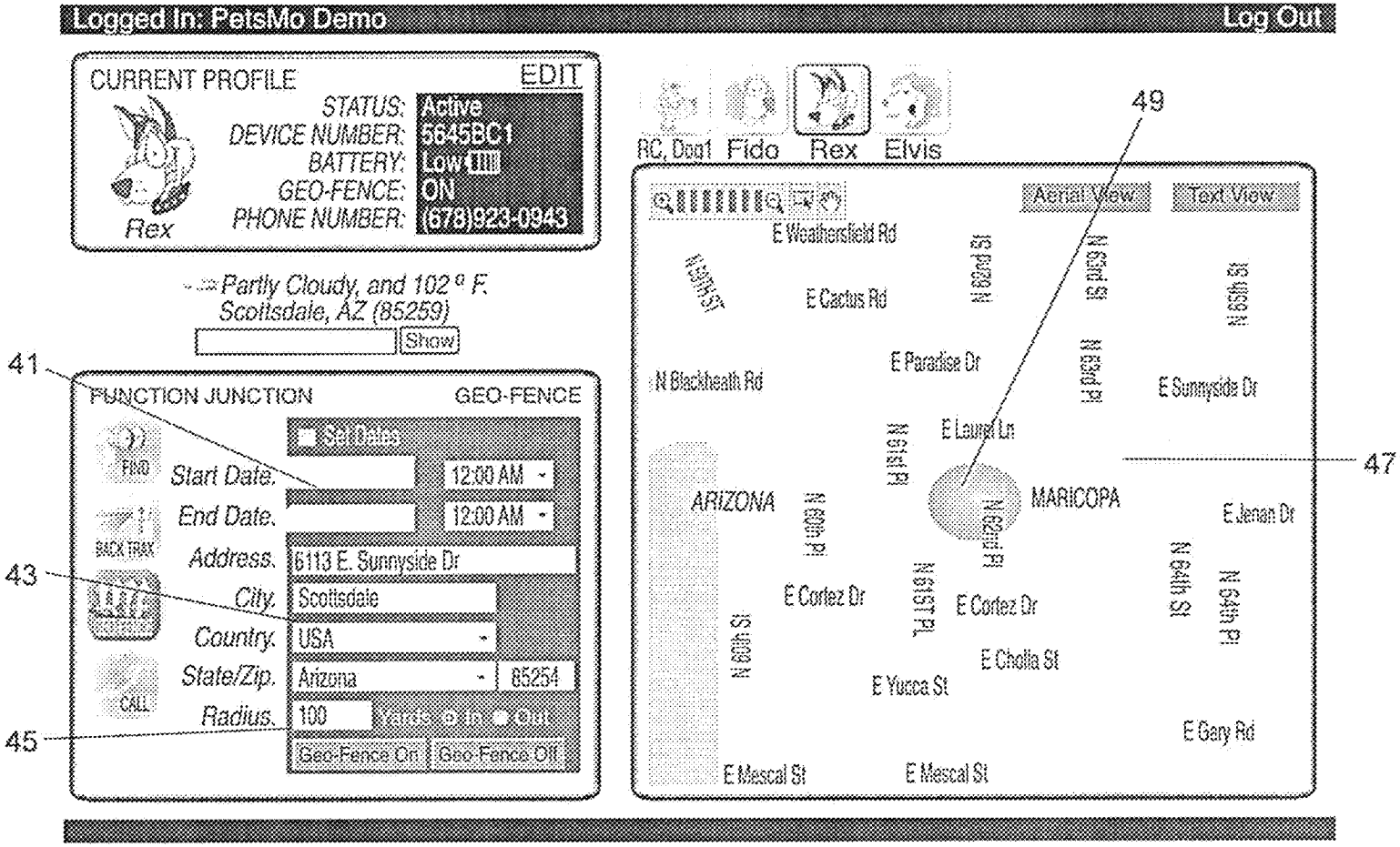
FIG. 4 illustrates a particular example of a user interface provided by a computer application or web application for Geofencing.

FIG. 4 graphically illustrates an embodiment utilizing a Geofence. A customer can set a Geofence at their current location by pressing a button 42 on the device 30. The button press initiates an immediate GPS location request and calculates the accuracy of this locate request. Once the locate and accuracy are calculated, the device establishes a Geofence around itself. The size of the Geofence is predetermined by manufacture settings and multiplied by the accuracy variable.

For example: The device 2 is at 123 My Street, My City, USA (longitude: −111.899046 and latitude: 33.665489). The accuracy is calculated at 10 meters, so the device knows within 10 meters where it is located. If the manufacture setting is a 20 meter Geofence around any device, we would multiply a 20 meter Geofence by 10 meter accuracy variable and establish a 200 meter Geofence around the device. The accuracy variable must be incorporated into the equation to prevent false alerts. A false alert would occur if the device was not exactly where the initial located calculation was established, and an attempt to Geofence that specific plot on a map was requested. Even if the device had not moved, the device would send a false alert on the next scheduled locate request, indicating it was outside the original Geofence area. Having a larger Geofence area helps reduce the risk of this happening because it encompasses the surrounding areas inside an inaccurate locate request when the Geofence is being established.

The Geofence can be turned on 34 or off 36 at the device level. Holding button 40 will create a Geofence and notify the customer with the audio prompt "Geofence On". Holding button 42 will end the Geofence setting and notify the customer with the audio prompt "Geofence Off".

A Geofence is represented in the GUI by a translucent circle 49 or circle outline overlaid onto a geographical earth map.

Figure 6:
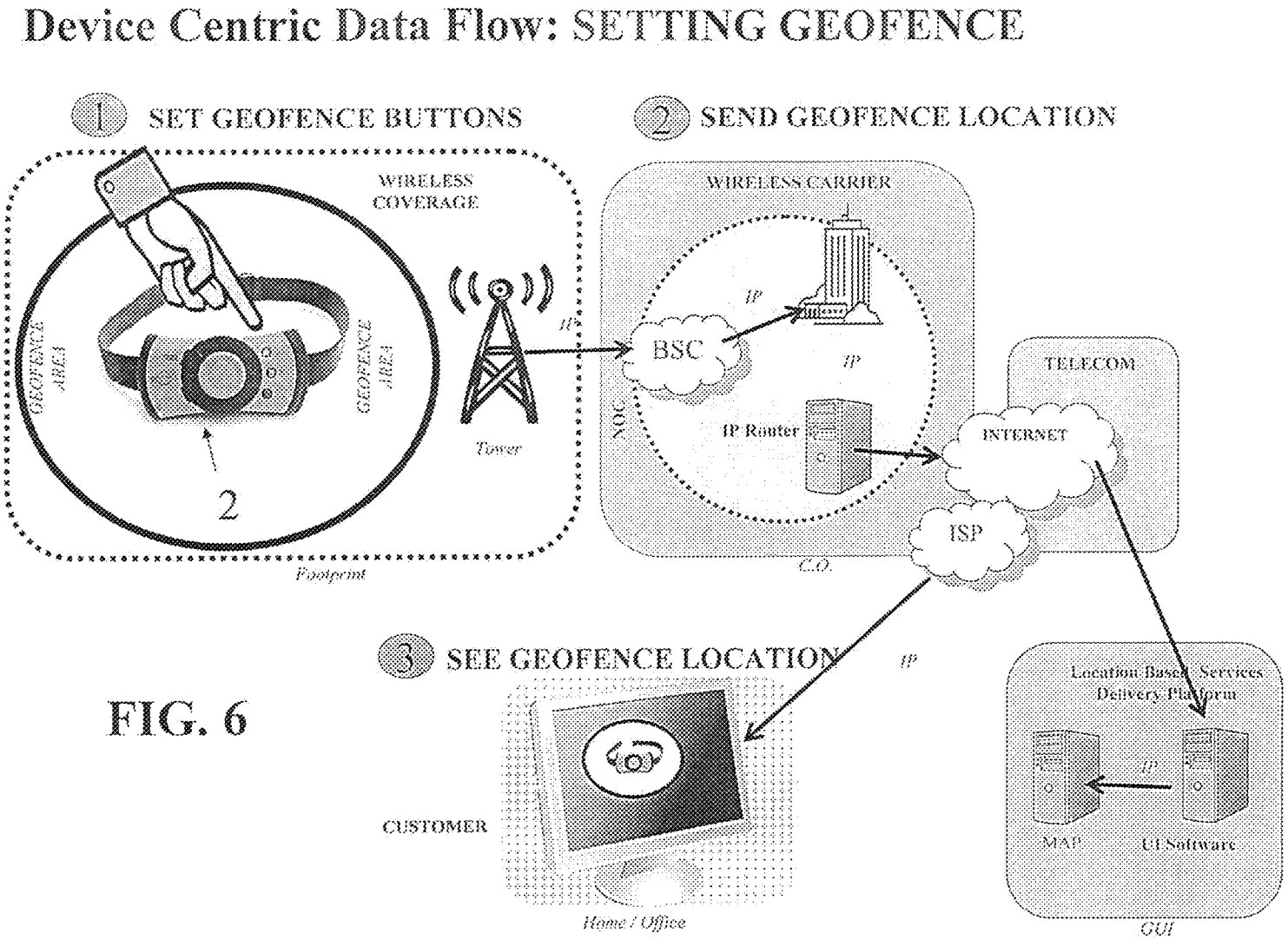
FIG. 6 schematically illustrates setting Geofence.

FIG. 6 schematically illustrates setting a Geofence, and comprises the following steps:

| SEQUENCE OF EVENTS | ACTION | RESULT |
|---|---|---|
| 1. | Customer presses button 40 on the remote device 30 for a selected time period | The device audio prompts "Geofence On". The device calculates its current location, accuracy of that location request and establishes a Geofence around itself. |
| 2. | Device sends Geofence settings to the GUI | Device location is sent from the hardware, over the wireless network to the GUI, where it is processed and catalogued. |
| 3. | Customer logs into the GUI | Customer can see the location of the device and Geofence area around the device, and/or make changes to the Geofence. |

The remote control 30 may include a means to secure itself to a belt clip holster or collar clip holster. The remote control may include a battery, and may also be provided with a magnetic induction charging system and operable to mate to the charger that is also used with the device.

Messaging transceiver systems may be incorporated into both the remote control and the device to enable messaging between the two. One of several messaging protocols may be used, as known to those skilled in the art. Optimally, a low power messaging system is used for preserving battery life.

Several types of messages may be sent from the remote control to the device, including: activation and deactivation of the device; activation and deactivation of the allowed device travel boundaries. The device may return acknowledgement messages to the remote control, and the remote control may resend the requests if a transmission failure is experienced.

Several types of messages may be sent from the device to the remote control, including: confirmation of activation and deactivation of the device; confirmation of activation and deactivation of the allowed device travel boundaries; and various alerts such as low battery, out of range detection and inbound call.

Receipt of messages on the device 2 may be communicated to a user with the visual indicator 14 (such as LED). For example, when the device 2 is activated or deactivated, or the allowed device travel boundaries are activated or deactivated, the visual indicator 14 may provide feedback using preset series of timed blinked. Furthermore the visual indicator 14 may be configured to blink at set intervals while the device is activated so that the user may confirm that the device has not turned off. The visual indicator 14 may provide a quick series of blinks, each series separated at set intervals, to indicate the continued activation of the allowed device travel boundaries. The visual indicator 14 may provide yet another type of blinking activity while the device is charging.

Optionally, the device and remote control may also include an audio speaker and a microphone to enable voice communications between the device and remote control. Methods of transmitting voice communications wirelessly are known to those skilled in the art. Certain methods may include the addition of a dial-pad to the remote control, to initiate communication to the device.

Alternately, the remote control may be replaced with a personal digital assistant (PDA) that is operable to enable the various functions described above.

Figure 3:
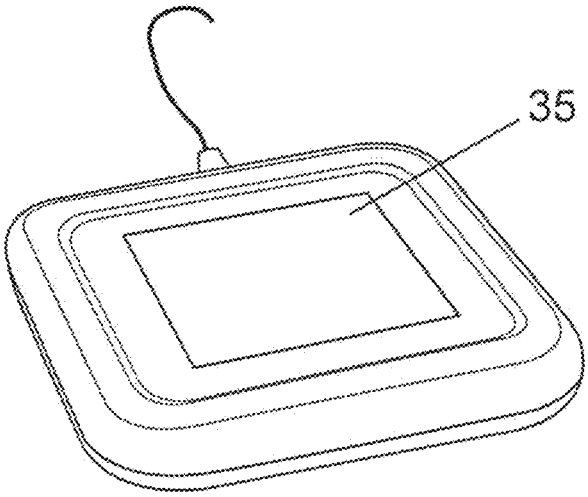
FIG. 3 illustrates a particular embodiment of a battery charger for use, with the device previously illustrated in FIG. 1 and the remote control previously illustrated in FIG. 2.

FIG. 3 illustrates a magnetic induction charging system charger for use with the device and remote control. The magnetic induction charging system may be any charger known to those skilled in the art. Magnetic induction charging uses magnetic induction to transfer power wirelessly from a charging base to a target device, which is typically enabled by incorporating an internal module into the device to accommodate magnetic induction charging system.

Optimally, the cradle portion (35) of the magnetic induction charging system is sized to comfortably fit the dimensions of the device and remote control, whichever is larger. Optimally, the device and remote control are of the same length and width, and the cradle (35) is slightly larger, to comfortably accommodate the device and remote control when charging.

Theft prevention may be included for the device. Event notification to the user may be provided if the device is removed, or is attempted to be removed, from the asset. Notification methods may include email, SMS, voice and/or fax, which may be configured using the user interface described below. Sensing of the device removal status may be enabled by several methods, including:

1) Embedding a magnet into the device and another magnet in the attachment means to the asset. When the two are separated, owner notification is initiated.
2) Providing a set of transceivers in the device and attachment means. The transceivers regularly communicate. When the transceivers are spatially separated, a failure to communicate is experienced, which is assumed to mean the device has been removed from the attachment means.

A user interlace (UI) may be provided to the user. The UI may be provided as a computer program or an internet web application.

The UI may allow a user to register its communication means. This may include registration of a phone number, email address, facsimile number, SMS number, etc. for purposes of receiving alerts in connection with the present invention.

One of the features accessible through the UI may be locating the device and associated asset. The location may be communicated to the user by viewing a map 47 with an indication of the current location of the asset (49). There may be several types of locate methods, including: ms-based, ms-assisted, cost efficient, and control plane. The use of ms-based, ms-assisted, and control plane locate methods are known to those skilled in the art. A cost-efficient method may include a first locate attempt, using the ms-based method, and upon failure a ms-assisted second attempt.

The user interface may also allow for activating, deactivating, and configuring the allowed device travel boundaries. The configuration of the device travel boundaries may allow for configuring the radius of the boundaries 45, which is described above. This configuration does not change the activation status. The central point of the allowed device travel boundaries may also be set using a post address 43. Additionally, a user may set a future timeframe 41 during which the allowed device travel boundaries will be activated.

Optionally, the UI used in conjunction with the device may provide a social networking capability for users. This may allow users of the system that are within close proximity to meet each other.

To accomplish the social networking aspect of the present invention: a user obtains a device and registers the device with a central registration application, such as a website (more fully described below); the central registration application provides a means for the user to update the device and remote controller a label, such as a pet name or user name; when the pet owner comes within a certain range of another registered remote control, the two remote controls temporarily pair with each other to exchange a text message, such as "Hello my name is X", introducing them to the other user.

Registration of the device with the central registration application may be comprised of several steps, including:

1) The user enters the label and the identification number of the device (such as IP address) into the application. Once these two fields are populated, the application generates a message (such as SMS message) to the device with the label.
2) The device receives the message, and populates a pre-defined field within the device firmware. Once that field is populated, a message is sent from the device to the remote control. Any future changes to the label using the application will also generate a message to the device and subsequently the remote control.
3) The remote control receives message and populates a pre-defined field within the remote control. Once that field is populated the display means of the remote control displays the label.
4) Upon receipt of the label, the remote control updates its profile to allow pairing with other remote controls, which may be disabled by default. This allows the remote control to pair with another remote control. When pairing occurs, the label is sent to the other remote control and displayed on the display means of the other remote control.

Thus the users are alerted to each other's presence.

The device 2 has an internally mounted Temperature Sensor and related application firmware. The physical sensor monitors the temperature of the device. The device can send its temperature status information wirelessly over the public network (currently CDMA/Code Division Multiple Access) to a GUI (Graphical User Interlace). The device 2 may be configured from the manufacture to check its internal temperature at any diagnostic frequency (example 1 min or 1 hour or 1 day). It may also be configured by the manufacture to send the information wirelessly to the GUI on a predefined communication schedule. The diagnostic frequency and communication schedule do not have to be identical.

The device 2 can initiate an alert that is sent directly to the subscriber. The alert is sent from the device 2, over the wireless network to the subscriber's pre-defined alert location. The subscriber may define and change what the alert methodology is through the GUI, which can include one or all of the following 1) an email 2) SMS (Short Message Service) 3) fax. The subscriber may also configure the specific address of the alert (examples: SMS=987.654.3210, email=subscriber@subscriber.com, fax=987.654.3210) from the GUI.

Defining the alert methodology and configuring the specific address of the alerts are facilitated through a GUI which is an ASP (Application Service Provider).

Temperature tolerances or thresholds may be defined by the subscriber through the GUI. Tolerance thresholds include a hot and cold setting. If either the hot or cold thresholds are exceeded (too hot or too cold), as they were entered into the GUI by the subscriber, an alert is sent to the subscriber the next time the device performs a self diagnostic.

Therefore in one application it is possible to determine if the animal is a potentially dangerous environment due to extreme temperature. In another application it is possible to determine if a perishable asset or other such as warehoused food is in an environment to be spoiled.

Figure 5:
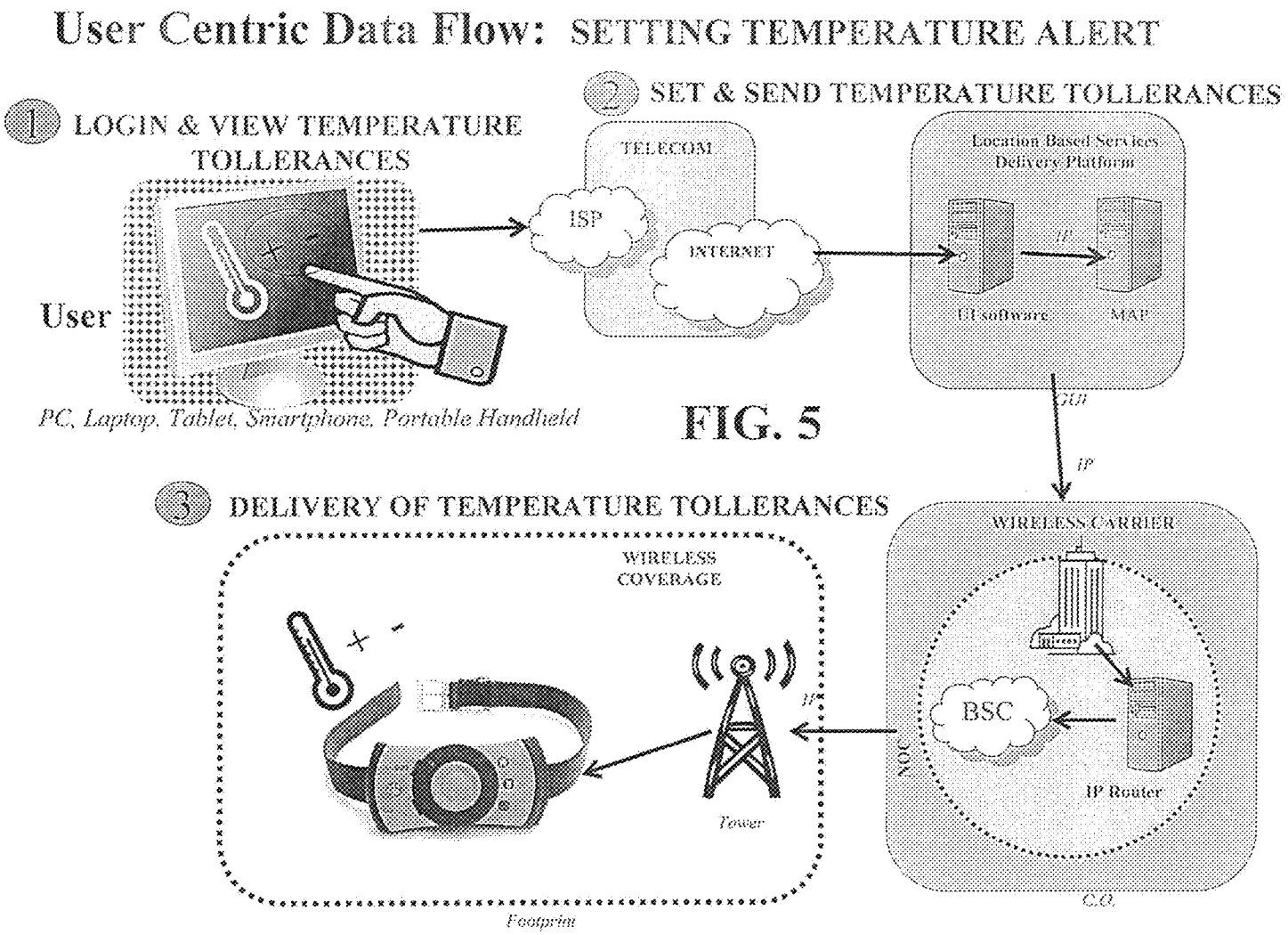
FIG. 5 schematically illustrates setting a Temperature alert.

FIG. 5 schematically illustrates Setting a Temperature alert and comprises the following steps:

| SEQUENCE OF EVENTS | ACTION | RESULT |
|---|---|---|
| 1. | Customer logs into GUI via an Internet enabled computer with user id and password | Customer can view their mobile device temperature reading, view and modify their device temperature settings and alert methodology |
| 2. | Customer configures temperature tolerances in online and saves settings | Customer modifies the temperature tolerances in the GUI settings to send an alert when the heat or cold increase at the device level |
| | Customer configures temperature alert methods | Customer enters their information into the GUI for alerts and chooses their preferred method of notification in the event an alert should be sent |
| 3. | Device receives temperature tolerance message | Device updates the high and low temperature settings and begins to monitor it's status based on the manufacture defined intervals (diagnostics) |
| 4. | Device exceeds it's hot or cold temperature tolerances | Device sends a message to the customer that there is an alert requiring their attention |

The invention claimed is:

1. A device for tracking warehoused items, comprising:

(a) a housing;
(b) a power unit;
(c) a positional tracking circuit;
(d) a switch for activating and deactivating the device;
(e) an indicator for communicating messages to a user of the device;
(f) an attachment for attaching said device to a warehoused item;
(g) a transceiver for determining whether said device is connected to said warehoused item;
(h) an altitude sensor for sensing an altitude of the device; and
(i) a two or three axis accelerometer;
(j) said device controlled by a remote control; said remote control including means to configure allowed device travel boundaries including setting future allowed device travel boundaries;
(k) wherein said two or three axis accelerometer;
(i) senses that the device is located out of the allowed device travel boundaries to indicate the device is lost or stolen; and
(ii) determines when and where the device was subjected to an impact for insurance purposes.

2. The device as claimed in claim 1, wherein the power unit comprises a battery and a battery charging circuit with a magnetic induction charging circuit.

3. The device as claimed in claim 1, wherein the positional tracking circuit is a global positioning system tracking circuit.

4. The device as claimed in claim 1, wherein the indicator is a visual indicator comprising a light emitting diode.

5. The device as claimed in claim 1, wherein said remote control comprises:

(i) a display screen;

(ii) a plurality of switches for activating and deactivating the device, querying the device status, and activating and deactivating the device features;

(iii) a battery; and (iv) a battery charging circuit.

6. The device as claimed in claim 5, wherein the remote control is a personal digital assistant.

7. The device as claimed in claim 5, wherein the battery charging circuit is a magnetic induction charging circuit.

8. The device as claimed in claim 5, wherein the battery of said remote control is charged using a magnetic induction battery charger.

9. A method for tracking warehoused items, wherein the method comprises the steps of:

(a) attaching a first device to a warehoused item with an attaching means, the first device operable to communicate its location to a second device; and (b) a user being in possession of the second device, the second device communicating to the user a location and an elevation of the first device and the warehoused item;

(c) determining whether the first device is attached to the warehoused item by:

(i) disposing a magnet with the first device, and another magnet with the attaching means; or (ii) disposing a transceiver with the first device and another transceiver with the attaching means;

and providing notification of disconnection when the magnets or transceivers are separated;

(d) sensing an altitude and a position of the first device;

(e) a three axis accelerometer to sense a change in the position and elevation of the first device, and when the first device is exposed to an impact;

(f) setting travel boundaries of the first device in a spatial range, including setting a future time frame for the travel boundaries during which the travel boundaries will be activated;

(g) wherein the three axis accelerometer:

(i) senses that the warehoused item is located out of the spatial range to indicate the warehoused item is lost or stolen; and (ii) determines when and where the warehoused item was subjected to an impact for insurance purposes.

10. The method as claimed in claim 9, wherein the second device is operable to enable and disable the first device to generate an alert to the second device when the first device travels outside the spatial range.

11. The method as claimed in claim 9, wherein the second device resends the communication to the first device if transmission failure is detected, and wherein the second device sets and sends temperature tolerances to the first device.

12. A non-transitory computer-useable medium encoded with a computer program comprising:

(a) computer readable program code recorded or storeable in the computer-useable medium, the computer readable program code defining a tracking application for a device attached to a warehoused item, that is operable to:

(i) receive location information from the device;

(ii) display on a map the location of the device;

(iii) receive event notification when the device is removed or attempted to be removed from the warehouse item;

(iv) enable a user to enable or disable travel boundaries and elevational change in a spatial range for the device, wherein an alert is provided to the user if the device travels outside the spatial range to indicate the device is lost or stolen;

(v) enable a user to enable or disable a timeframe for said spatial range to be activated; including enabling a user to set a future time frame during which the spatial range will be activated;

(vi) enable a user to configure a radius and centerpoint for said spatial range; and (vii) define temperature tolerances of the device;

(viii) enable a user to determine when and where the device is exposed to an impact for insurance purposes by utilizing a two or three axis accelerometer of the device; and (ix) enable the device to return acknowledgement message to the user.

13. The computer-useable medium as claimed in claim 12, further comprising enabling a user to register the device, said registration including the user providing to the computer program, personal contact information, to be used by the computer program to provide alerts to the user.

* * * * *